US011713620B2

(12) United States Patent
Marocco

(10) Patent No.: US 11,713,620 B2
(45) Date of Patent: Aug. 1, 2023

(54) BLIND CONTROL HAVING A NARROW PROFILE DRIVE

(71) Applicant: MAXXMAR INC., Toronto (CA)

(72) Inventor: Norbert Marocco, Toronto (CA)

( * ) Notice: Subject to any disclaimer, the term of this patent is extended or adjusted under 35 U.S.C. 154(b) by 531 days.

(21) Appl. No.: 16/168,620

(22) Filed: Oct. 23, 2018

(65) Prior Publication Data

US 2019/0119981 A1 Apr. 25, 2019

Related U.S. Application Data

(60) Provisional application No. 62/576,437, filed on Oct. 24, 2017.

(51) Int. Cl.

| | |
|---|---|
| ***E06B 9/76*** | (2006.01) |
| ***E06B 9/78*** | (2006.01) |
| ***E06B 9/42*** | (2006.01) |
| ***E06B 9/322*** | (2006.01) |
| ***E06B 9/90*** | (2006.01) |
| ***E06B 9/50*** | (2006.01) |
| *E06B 9/28* | (2006.01) |

(52) U.S. Cl.

CPC ..... *E06B 9/76* (2013.01); *E06B 9/322* (2013.01); *E06B 9/42* (2013.01); *E06B 9/50* (2013.01); *E06B 9/78* (2013.01); *E06B 9/90* (2013.01); *E06B 2009/285* (2013.01); *E06B 2009/905* (2013.01)

(58) Field of Classification Search

CPC ..... E06B 9/76; E06B 9/78; E06B 9/32; E06B 9/50; E06B 9/42; E06B 9/322; E06B 9/74; E06B 9/307; E06B 9/30; E06B 9/326; E06B 2009/785; E06B 2009/285

See application file for complete search history.

(56) References Cited

U.S. PATENT DOCUMENTS 1,744,686 A * 1/1930 Pease ..... E06B 9/174 160/309
1,833,480 A * 11/1931 Baumbach ..... E06B 9/174 160/309
3,194,366 A * 7/1965 Erich ..... E06B 9/307 192/223.2

(Continued)

FOREIGN PATENT DOCUMENTS

GB 2486555 B * 9/2016 ..... E06B 9/78

*Primary Examiner* — Johnnie A. Shablack

(74) *Attorney, Agent, or Firm* — Eugene Joseph Gierczak

(57) ABSTRACT

A blind control for a window covering having a narrow profile; and particularly relates to a control module for a window shade where the location of the drive mechanism is selected to minimize the gap between the end of the window shade and inside edge of a window opening; locating the drive mechanism in a shell disposed in a housing to rigidity a reduced thickness of the drive so as to minimize the gap; and use a single rod depending from the control module to activate the drive mechanism in a safe and secure manner. The invention also includes a housing with an end wall adjacent one end of the shade; a clutch projecting from said end wall and rotatable about a clutch axis, a drive gear engageable at one end of the clutch for rotatably driving said clutch and shade, said drive gear disposed in said housing adjacent said end wall; and a wand for driving said drive gear.

23 Claims, 17 Drawing Sheets

(56) References Cited

U.S. PATENT DOCUMENTS 3,918,513 A * 11/1975 Englund ..... E06B 9/307 160/176.1 R
4,238,969 A * 12/1980 Krause ..... E06B 9/76 74/411.5
4,372,367 A * 2/1983 Baldanello ..... E06B 9/74 160/310
4,406,319 A * 9/1983 McNiel ..... E06B 9/307 160/177 R
4,522,245 A 6/1985 Anderson
4,541,468 A * 9/1985 Anderson ..... E06B 9/307 160/177 R
4,676,292 A * 6/1987 Valle ..... E06B 9/307 160/176.1 R
4,759,398 A * 7/1988 Renee ..... E06B 9/326 160/177 R
4,869,308 A * 9/1989 Chang ..... E06B 9/307 160/176.1 R
4,873,740 A * 10/1989 Vahrenwald ..... B60S 1/3404 15/250.003
4,875,516 A * 10/1989 Marocco ..... E06B 9/36 464/30
5,293,921 A * 3/1994 Marocco ..... E06B 9/307 160/176.1 R
5,476,132 A * 12/1995 Jacobson ..... E06B 9/368 160/168.1 V
5,603,371 A * 2/1997 Gregg ..... E06B 9/307 160/176.1 P
5,787,953 A * 8/1998 Jacobson ..... B25B 15/06 160/168.1 R
5,850,863 A * 12/1998 Huang ..... E06B 9/307 160/168.1 R
6,044,890 A * 4/2000 Renee ..... E06B 9/303 160/177 R
6,089,303 A * 7/2000 Metcalf ..... E06B 9/307 160/176.1 R
6,176,290 B1 * 1/2001 Hsu ..... E06B 9/322 160/115
RE37,143 E * 4/2001 Liu ..... E06B 9/322 160/177 R
6,298,897 B1 * 10/2001 Metcalf ..... E06B 9/307 160/176.1 R
6,308,764 B1 * 10/2001 Lin ..... E06B 9/322 160/177 R
6,325,133 B1 * 12/2001 Lin ..... E06B 9/322 160/177 R
6,685,592 B2 2/2004 Fraczek et al.
6,805,186 B1 * 10/2004 Nien ..... E06B 9/322 160/177 R
6,945,302 B2 * 9/2005 Nien ..... E06B 9/308 160/170
6,973,952 B2 12/2005 Nien
7,089,988 B2 8/2006 Coleman
7,204,292 B2 4/2007 Nien
7,581,579 B2 * 9/2009 McCormick ..... E06B 9/322 160/309
8,205,658 B1 * 6/2012 Lin ..... E06B 9/78 160/320
8,251,119 B2 * 8/2012 Toti ..... E06B 9/322 160/168.1 R
8,522,854 B2 * 9/2013 Lin ..... E06B 9/42 160/309
8,851,148 B2 * 10/2014 Lin ..... E06B 9/40 160/291
8,910,696 B2 * 12/2014 Wen ..... F16D 1/101 160/177 R
9,062,492 B2 * 6/2015 Yu ..... E06B 9/322
9,187,951 B2 11/2015 Yu et al.
9,376,859 B1 6/2016 Deward et al.
9,528,318 B2 12/2016 Huang et al.
9,567,802 B2 2/2017 Buccola, Jr. et al.
9,657,517 B2 * 5/2017 Huang ..... E06B 9/32
9,765,864 B2 * 9/2017 Yu ..... E06B 9/78
9,797,191 B2 * 10/2017 Huang ..... E06B 9/322
9,801,486 B2 * 10/2017 Mullet ..... A47H 23/01
9,938,764 B2 * 4/2018 Huang ..... F16H 3/54
10,513,883 B2 * 12/2019 Huang ..... E06B 9/322
10,736,452 B2 * 8/2020 Mullet ..... B23B 3/00
11,428,045 B2 * 8/2022 Marocco ..... F16H 37/041
2009/0288507 A1 * 11/2009 Toti ..... E06B 9/322 74/89.23
2011/0259533 A1 * 10/2011 Lin ..... E06B 9/76 160/340
2014/0290875 A1 * 10/2014 Chen ..... E06B 9/307 160/149
2015/0107788 A1 * 4/2015 Mullet ..... A47H 5/0325 160/405
2015/0225997 A1 * 8/2015 Soper ..... F16H 1/16 160/309
2015/0368969 A1 * 12/2015 Lin ..... E06B 9/76 242/395
2016/0017964 A1 1/2016 Yu
2016/0138334 A1 * 5/2016 Dean ..... E06B 9/76 160/309
2017/0022754 A1 * 1/2017 Nien ..... E06B 9/307
2017/0172333 A1 * 6/2017 Mullet ..... A47H 1/02
2019/0032400 A1 * 1/2019 Lin ..... E06B 9/32
2019/0153777 A1 * 5/2019 Byun ..... E06B 9/40
2019/0264502 A1 * 8/2019 Marocco ..... E06B 9/50

* cited by examiner

BLIND CONTROL HAVING A NARROW PROFILE DRIVE

FIELD OF THE INVENTION

The invention relates to a blind control for a window covering having a narrow profile; and particularly relates to a control module for a window shade where the location of the drive mechanism is selected to minimize the gap between the end of the window shade and window opening; locating the drive mechanism in a shell disposed in a housing to rigidity a reduced thickness of the drive so as to minimize the gap between the end of the window shade and the inside edge of the window opening; and use a single rod depending from the control module to activate the drive mechanism in a safe and secure manner.

The invention also includes a housing with a control end wall adjacent one end of the shade roll; a clutch projecting from said control end wall and rotatable about a clutch axis, a drive gear engageable at one end of the clutch for rotatably driving said clutch and shade roll, said drive gear disposed in said housing adjacent said control end wall; and a wand for driving said drive gear.

BACKGROUND OF THE INVENTION

Blinds for building openings, eg windows, doors and the like, may be operated either simply down and up, in the case of eg. roller blinds, or in the case of eg. vertical shade panels, the vertical shade panels may be rotated open or closed.

The control elements for these blind operations are usually in the form of an endless cord or chain. The control element simply hangs down along one side of the building opening, in an endless loop.

Other forms of blinds and window coverings may also be operated by means of an endless control element hanging in a loop.

Generally speaking clutch mechanisms have been used in the window covering industry to inhibit the unwanted unrolling of window blinds. These clutch mechanisms have generally been used with sprocket wheels located at the end of window blinds so that the gap between the end of the blind and window frame is controlled to minimize the amount of unwanted light infused into a room. Generally speaking the use of spur gears and worm or bevel gears have not been widely used as they tend to increase the gap between the end of the window shade and window frame. When they have been used, attempts to reduce the thickness of such drives tended to produce a drive that flexed and wandered, and they tended to "bind" when used.

Furthermore there is great interest to provide a child safe environment so that it is desirable to use a single rod to activate the gear drive in a window shade as opposed to using an endless loop which can endanger a child.

For example US 2016/0017964 relates to a control module of a window shade includes a drive axle affixed with a sleeve, an arrester assembled around the sleeve, a cord drum connected with an operating cord, a clutch operable to couple and decouple the cord drum with respect to the drive axle, and a release unit including a stick that is operatively connected with the arrester. The arrester blocks rotation of the drive axle in a locking state, and has an unlocking state allowing rotation of the drive axle. The operating cord is pulled to drive the cord drum in rotation and turn the clutch to a coupling state, such that the rotation of the cord drum is transmitted through the clutch to drive the drive axle in rotation for raising the shading structure. Moreover, the stick is operable to switch the arrester from to the unlocking state for lowering the shading structure by gravity action.

U.S. Pat. No. 9,187,951 shows a window shade comprises a head rail, a shading structure, a bottom part, suspension cords connected with cord winding units, and a control module. The control module includes a drive axle assembled with the cord winding units, a sleeve affixed with the drive axle, an arrester assembled around the drive axle, and a release unit. The arrester has a locking state in which the arrester blocks a rotational displacement of the sleeve and the drive axle to keep the bottom part at a desired position, and an unlocking state in which rotation of the sleeve and the drive axle is allowed to lower the bottom part by gravity action. The release unit includes an actuator that is operatively connected with the arrester and has an elongated shape. The actuator can rotate about its lengthwise axis to turn the arrester from the locking to unlocking state.

U.S. Pat. No. 6,685,592 relates to a bi-directional clutch for operating a window dressing such as a roller shade includes a protective guard for securing the window dressing to a stationary structure, a gear box for transmitting rotation to an output member in response to the operation of an elongated operating member such as a cord, and an anti-rotational member that prevents the undesirable operation of the output member. The output member is coupled to the window dressing. The gear box includes a gear pulley coupled to the elongated operating member, a planetary gear and a stationary gear. The gear box is arranged and constructed to transmit motion to the output member in response to the activation of the elongated operating member, at a predetermined mechanical advantage.

U.S. Pat. No. 4,522,245 shows a housing for a Venetian blind tilter mechanism. The housing comprises a single piece integrally molded body having apertures in the walls of the body serving as bearing journals for a tilter shaft having a worm gear thereon and serving as bearing journals for a worm wheel in meshing engagement with the worm gear.

U.S. Pat. No. 9,528,318 relates to a window shade that includes a head rail, a bottom part, a shading structure arranged vertically between the head rail and the bottom rail, a winding unit having a suspension member connected with the bottom part, and the actuating system arranged in the head rail. The winding unit is rotationally coupled with the transmission axle, wherein the transmission axle rotates in the second direction to cause unwinding of the suspension member from the winding unit for lowering the bottom part, and in the first direction to wind the suspension member into the winding unit for raising the bottom part.

U.S. Pat. No. 9,567,802 discusses a covering for an architectural opening having nested rollers.

U.S. Pat. No. 9,376,859 teaches a tilter assembly is operatively connected to the slats for tilting the slats and comprises a wand shaft operatively connected to a worm gear. A drive gear operatively connected to a tilt shaft, and at least one idler gear connects the worm gear to the drive gear. The axis of rotation of the wand shaft is disposed at an angle relative to the plane to space a wand controller from the front plane. The wand shaft may include a wand connector that is releasably connected to the tilter assembly.

U.S. Pat. No. 7,089,988 shows window blind opening and closing device.

U.S. Pat. No. 7,204,292 illustrates A window blind is constructed to include a headrail, a blind body suspended below the headrail, a linking mechanism mounted inside the headrail and having a power input device fastened pivotally with the headrail and an actuator rotatable with the power input device and connectable to the blind body, and a driving control mechanism. The driving control mechanism includes a suspension rod suspended from the headrail and a controller detachably coupled to the suspension rod for enabling the suspension rod to be driven by the controller to rotate the power input device and to further drive the actuator to move the blind body, causing the blind body to change the window shading status.

Also U.S. Pat. No. 6,973,952 relates to an anti-reverse transmission for use in a window blind includes a fixed axle, a rotatable input shaft, an output shaft sleeved onto the fixed axle, a transmission shaft sleeved onto the output shaft and coupled to a linking rod of a window blind, the transmission shaft having a protrusion inserted into an opening in the output shaft, and a spiral spring fitted on the fixed axle within the output shaft. The spiral spring has two end tips suspended in the opening such that the spiral spring is radially expanded to disengage the output shaft from the fixed axle for rotation with the transmission shaft and the input shaft upon rotation of the input shaft, and the spiral spring is radially compressed to stop the output shaft from rotation when the transmission shaft receives a biasing force from the gravity weight of a blind body of the window blind.

These and other prior art devices and blind controls attempt to block out the light coming from outside the window particularly when a person desires to sleep.

It is an object of this invention to provide an improved blind control for a window covering.

It is another object of this invention to locate the drive mechanism to minimize the gap between the end of the window shade and window frame.

Another object of this invention relates to locating the drive mechanism in a shell or cage disposed in a housing to rigidify a reduced thickness of the drive so as to minimize the gap.

Yet another object of this invention relates to the use a single rod depending from the control module to activate the drive mechanism in a safe and secure manner.

It is another object of this invention to provide a narrow profile control module for a window shade to minimize light from outside the window infiltrating the room.

SUMMARY OF INVENTION

It is an aspect of this invention to provide a control module for a window shade for a window opening comprising; a driven gear disposed between the window shade and an edge of the window opening so as to define a gap there between; a drive gear located outside the gap and engageable with said window shade for rotatably driving the driven gear so as to raise and lower said window shade relative the window opening; and a rod for driving said drive means.

In one embodiment the control module includes a housing having an end wall adjacent the inside edge of the window opening, a clutch disposed within said housing and engageable with the window shade, where the driven gear is engageable with the clutch and disposed between the window shade and the end adjacent the edge of the window opening.

In another embodiment the housing includes a first housing portion for receiving the driven gear and a second housing portion communicating with the first housing portion, the second housing portion receiving the drive gear. In Another embodiment the housing includes a shell plate for covering the driven gear in said first chamber and for covering the drive gear in the second chamber and constrain the drive gear and driven gear against binding.

In another embodiment the second housing portion is axially spaced from the clutch axis.

In a further embodiment the driven gear comprises a spur gear disposed at the one end of the clutch between the end wall and the one end of the shade so as to define a narrow gap between the one end of said shade and the inside edge of said window opening. The thickness of said spur gear along said clutch axis in one example is between 5 to 8 millimeters.

Other embodiments include at least one intermediate gear between the spur gear and the drive gear. Also the drive gear can be either a worm wheel or bevel gear.

In yet another embodiment the clutch includes selectively engageable braking structure for preventing the shade from unrolling when the driven gear is idle.

It is another aspect of the invention to provide a narrow profile control module for a window shade roll comprising; a housing disposed at one end of said window shade roll, said housing having a control end wall and a first cavity and a second cavity, said first cavity communicating with said second cavity; a spur gear disposed in said first cavity between said control end wall and one end of said window shade roll, and defining a gap between said one end of the window shade and window opening; a clutch projecting from said spur gear into said window shade roll, said spur gear rotatably engageable with said clutch about a clutch axis for raising and lowering said window shade relative the window opening; a drive gear disposed in the second cavity away from the clutch axis so as to not interfere with the gap; the drive gear engageable with the spur gear for rotatably driving the clutch about the clutch axis for raising and lowering the window shade; a rod connected to the drive gear for rotatably driving the spur gear.

In one embodiment the driven gear between said end wall and the one end of the blind is between 5 and 8 millimeters.

In another embodiment of the invention the drive gear is a worm gear engageable with the spur gear. The invention also includes at least one intermediate gear between the spur gear and the drive gear. The drive gear can also be either a worm gear or bevel gear.

In a further embodiment the housing includes a cover plate to cover the first cavity and the second cavity and the one end of the shade contacts the cover plate in the first cavity to define the gap between the cover plate covering the first cavity and the end wall.

Another embodiment includes a wand having one end connected to the drive gear and a handle at another end for manually rotating the wand and drive gear.

Furthermore in yet another embodiment the wand includes a shaft defining spiral grooves and a hand portion coaxially receiving the shaft for reciprocal movement of the hand portion relative the shaft to rotate the wand in a selected first or second direction. The hand portion includes a slideable selector for selecting the direction of rotation of said drive gear means.

These and other objects and features of the invention will; be described in relation to the following drawings.

IN THE DRAWINGS

Figure 5A:
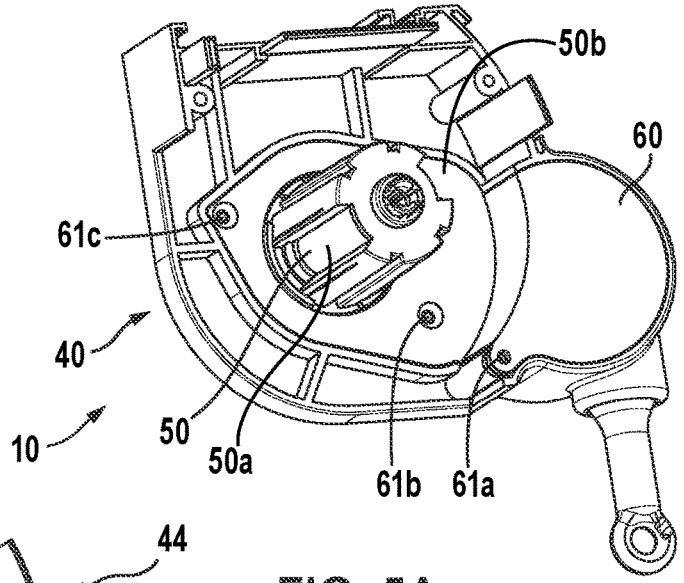
Figure 5B:
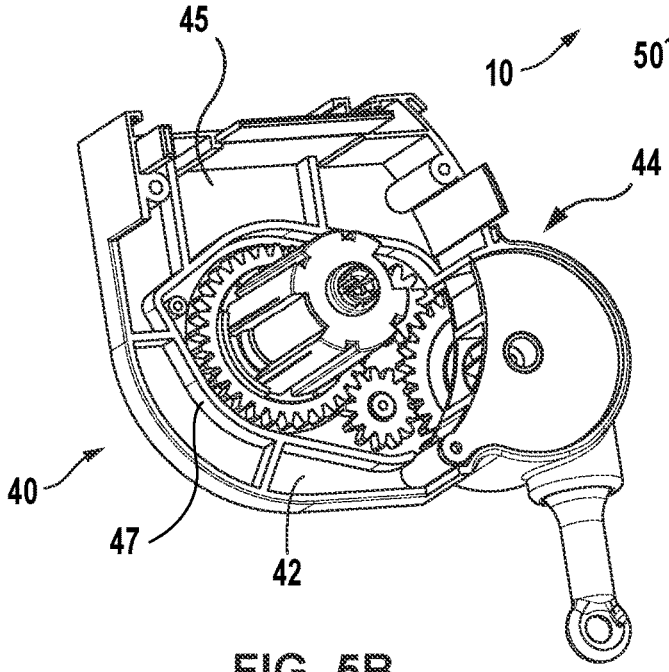
Figure 5C:
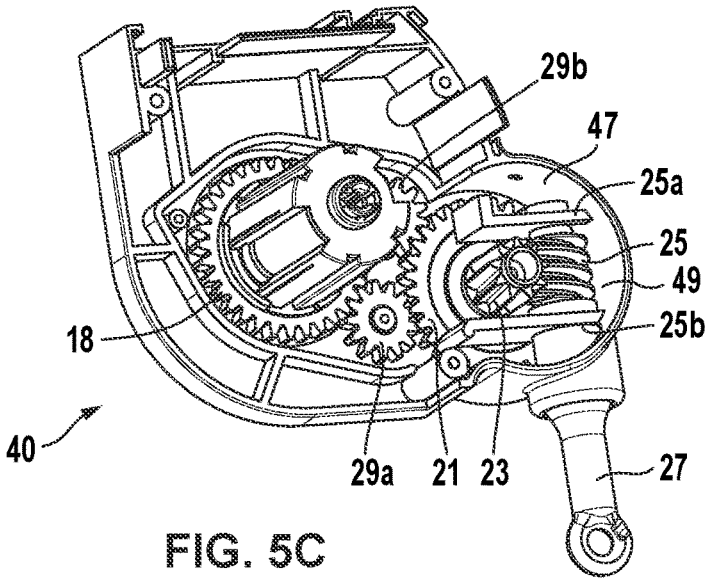

FIGS. 5A, 5B, and 5C are partial perspective views of the interior cavities of the first and second cavities at various stages of assembly.

Figure 6B:
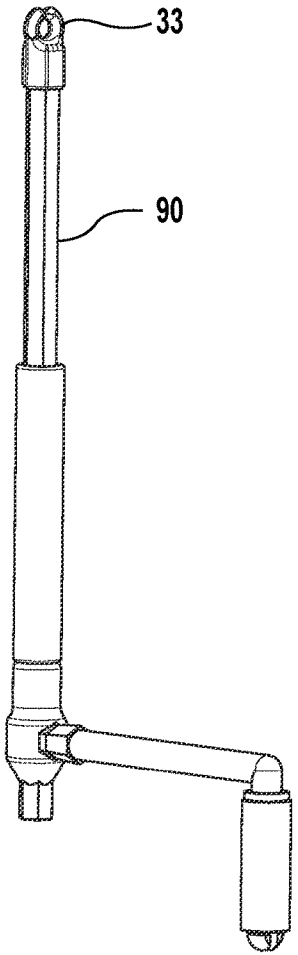
Figure 6A:
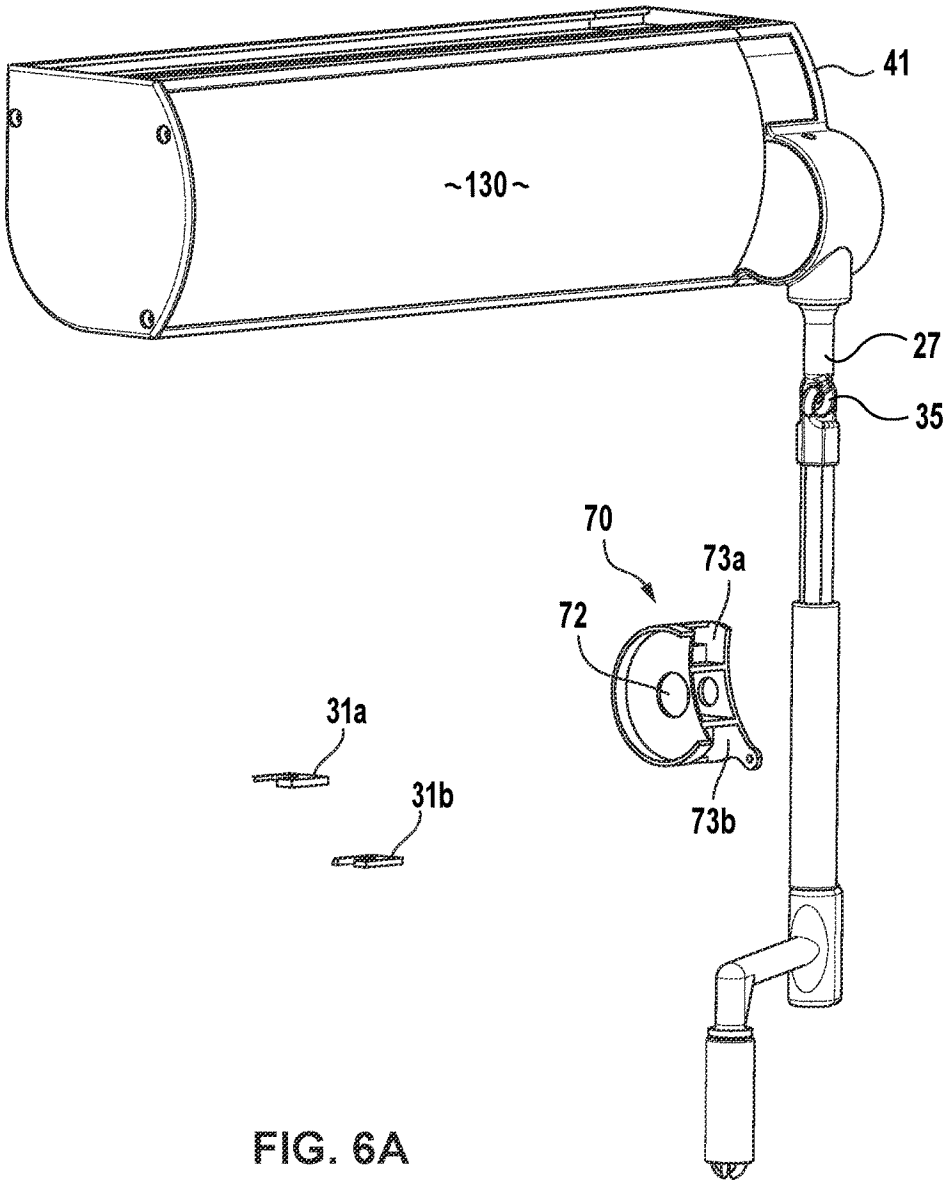

FIGS. 6A and 6B are perspective views of the narrow profile control module for a window shade and wand.

Figure 7B:
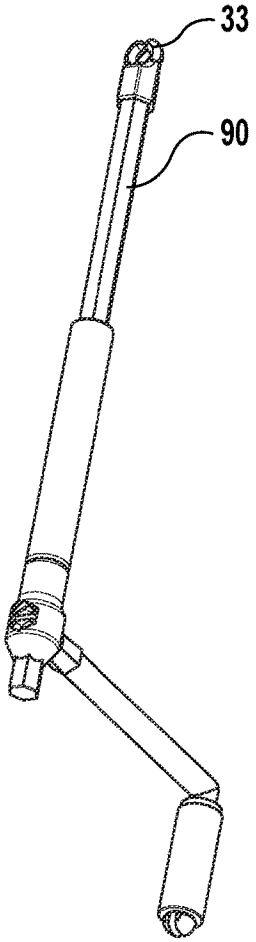
Figure 7A:
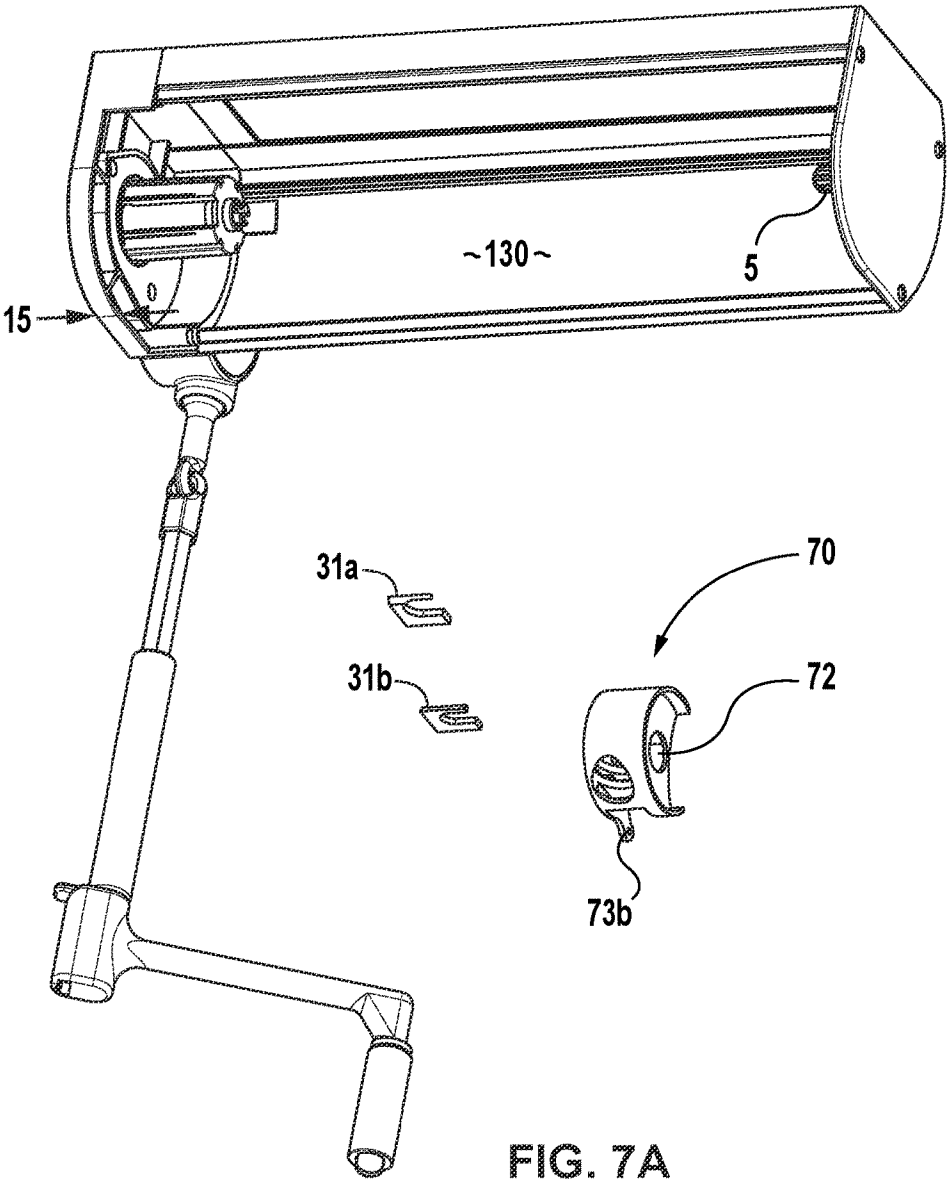
Figure 8D:
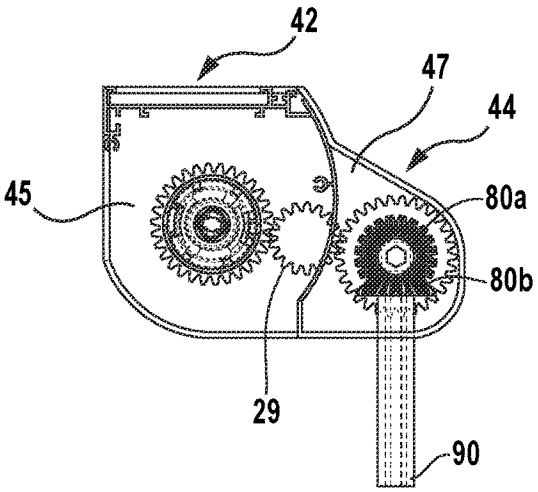
Figure 8C:
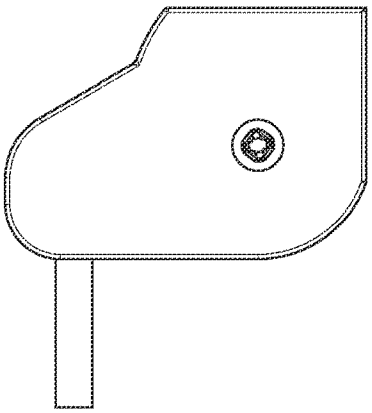
Figure 8B:
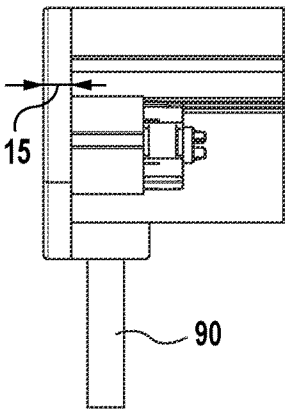
Figure 8A:
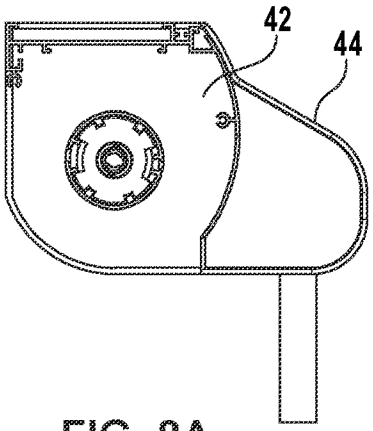
Figure 8H:
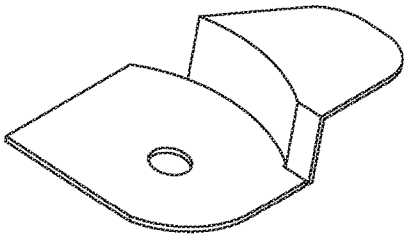
Figure 8G:
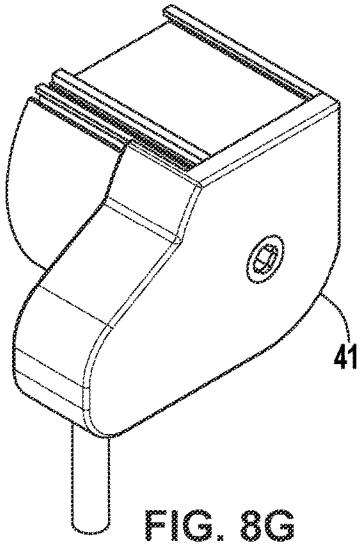
Figure 8F:
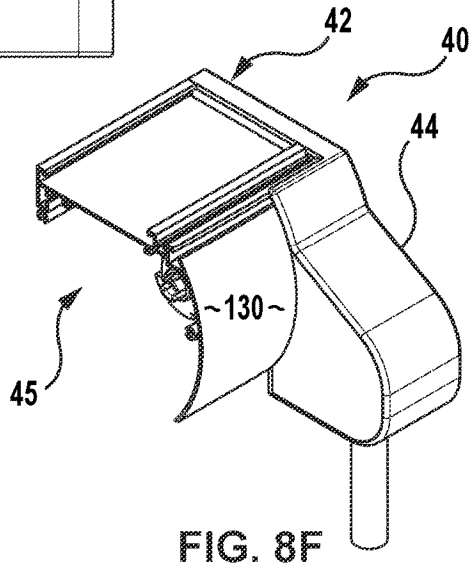
Figure 8E:
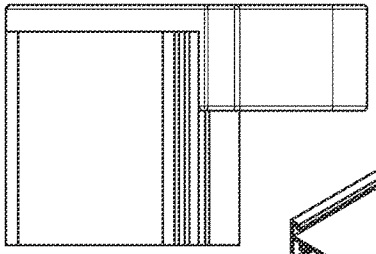

FIGS. 7A and 7B are further perspective views of the interior of the housing of the narrow profile control module for a window shade and wand.

FIGS. 8A, 8B, 80, 8D, 8E, 8F, 8G, and 8H are various views of another embodiment of the invention.

FIGS. 9A, 9B, 90, 9D and 9E are side views of another embodiment of the rod or wand.

Figure 10A:
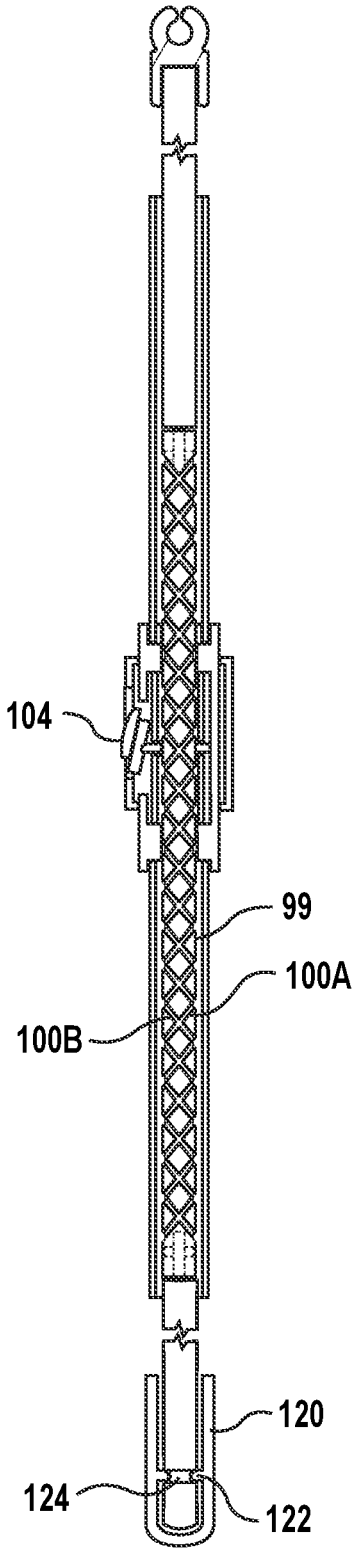
Figure 10B:
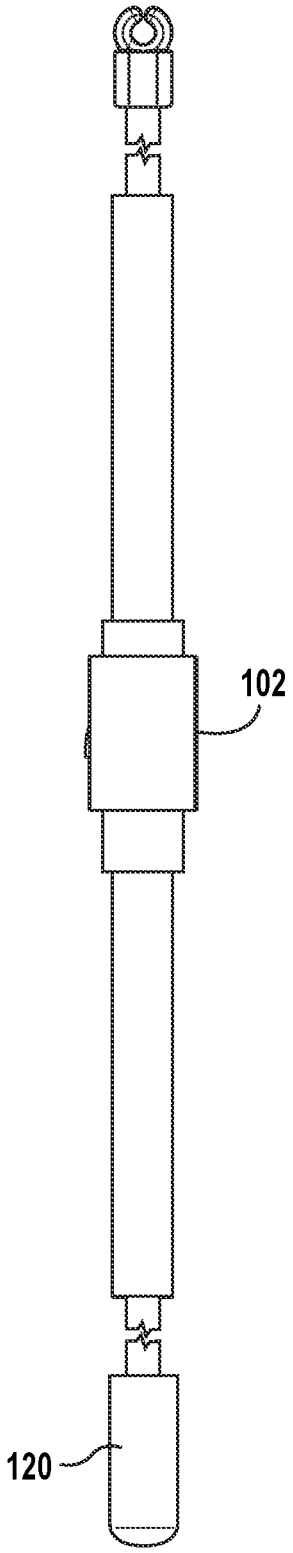
Figure 10C:
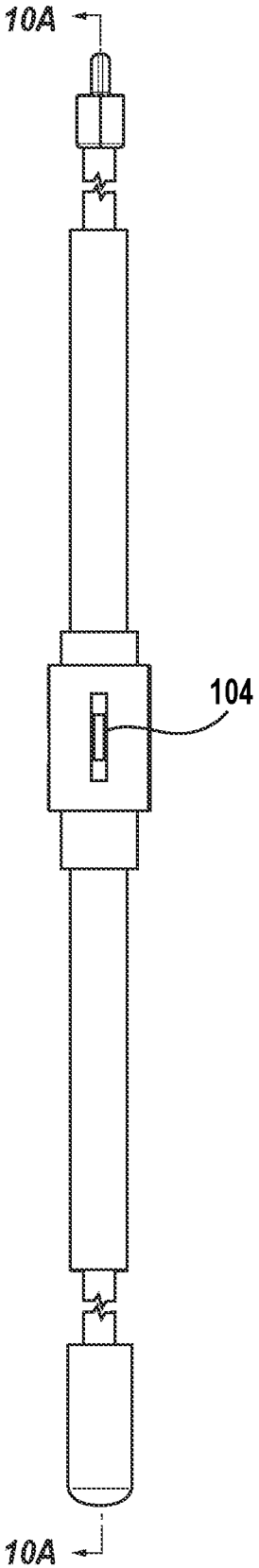

FIGS. 10A, 10B and 10C are a view of the wand having helical grooves.

FIGS. 11A, 11B, 11C, 11D and 11E are a front elevation view with the shade lowered, a rear elevation view with the shade lowered, cross sectional view with the shade lowered and a front elevation view with the shade raised, and a perspective view of the narrow profile control module, respectively.

FIGS. 12A, 12B, 12D, 12E and 12F are various cross sectional views of another embodiment of a wand having helical protrusions.

Figure 13:
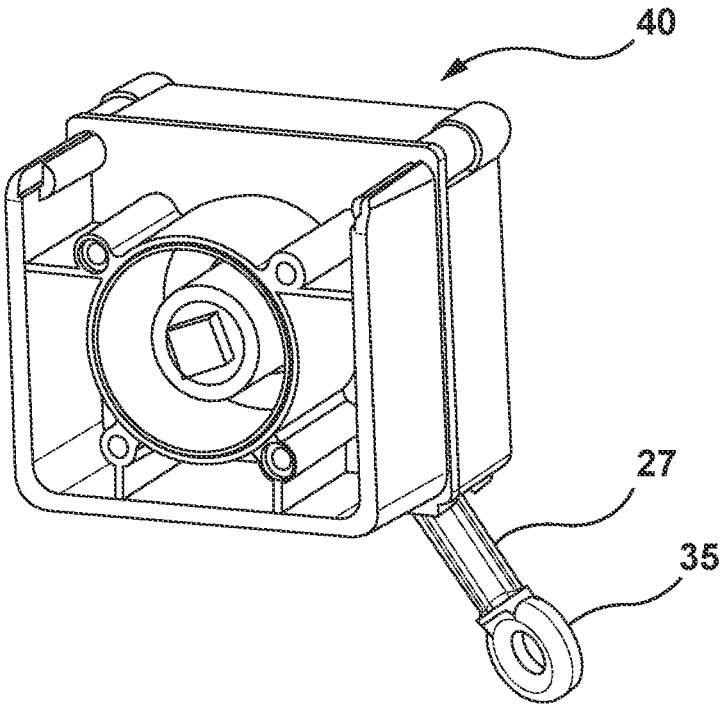

FIG. 13 is a perspective view of another embodiment of a housing whereby a drive shaft is disposed at an angle.

Figure 14:
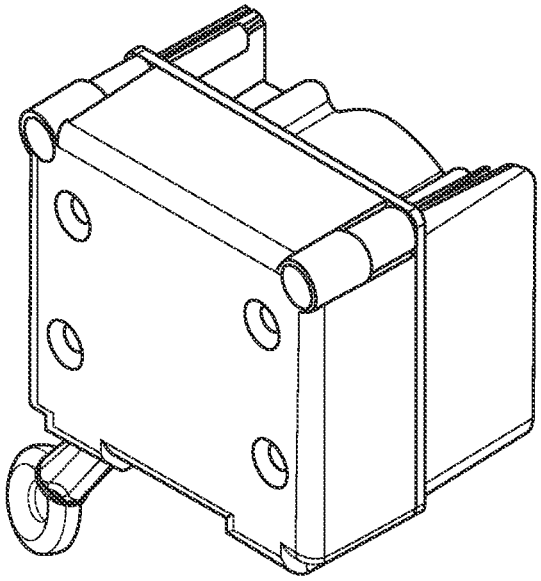

FIG. 14 is a rear perspective view of the FIG. 13.

Figure 15:
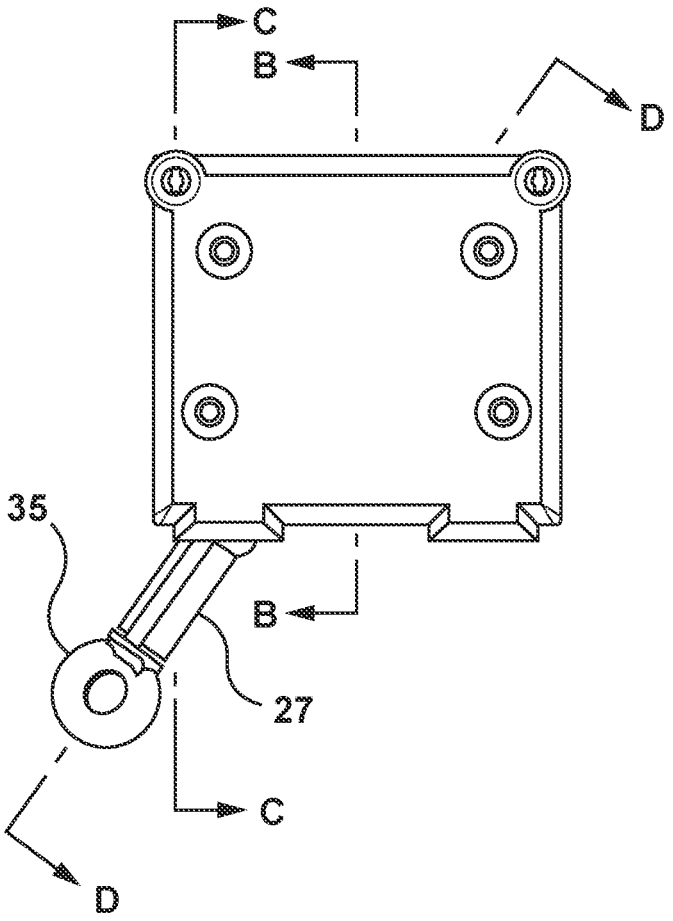

FIG. 15 is a rear elevational view of the embodiments shown is FIGS. 13 and 14.

Figure 16:
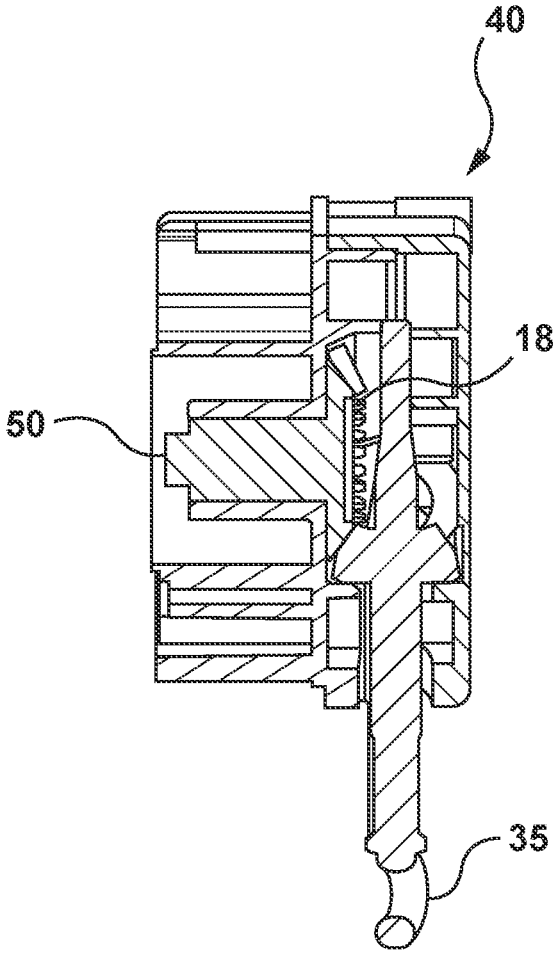

FIG. 16 is a cross sectional view of FIG. 15 along the line D-D.

Figure 17:
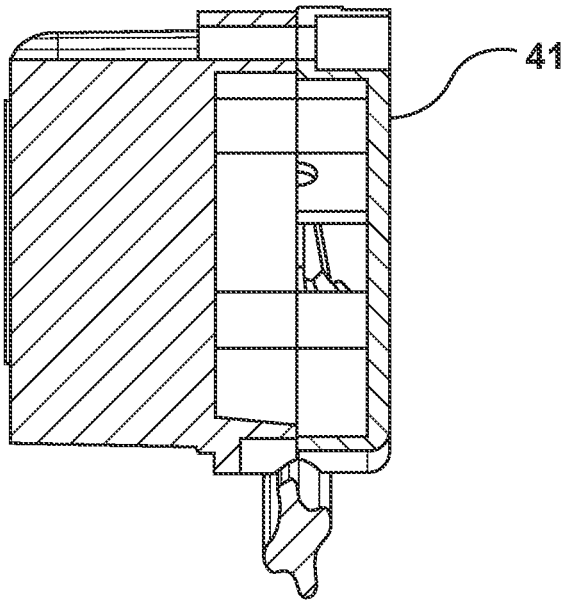

FIG. 17 is a cross sectional view of FIG. 16 along the line C-C.

Figure 18:
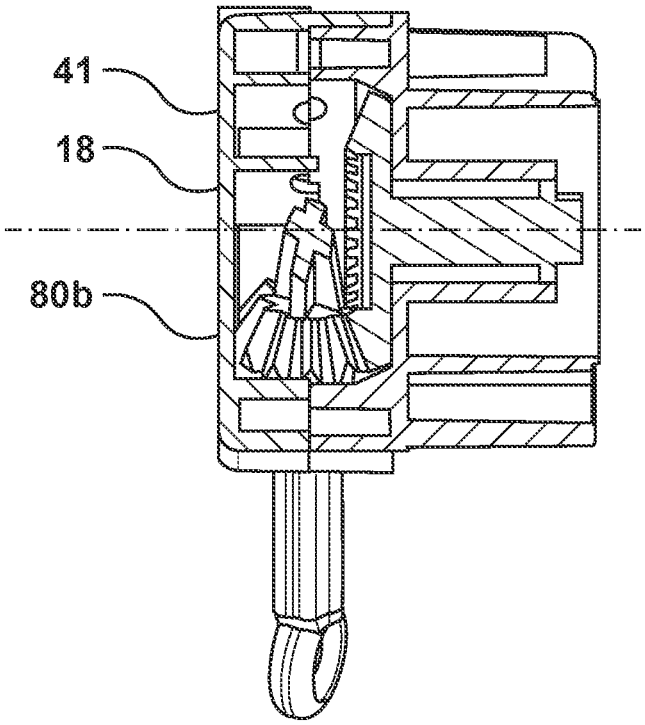

FIG. 18 is a cross sectional view of FIG. 15 along the line B-B

DETAILED DESCRIPTION OF THE INVENTION

Like parts are given like numbers throughout the figures.

Figure 1:
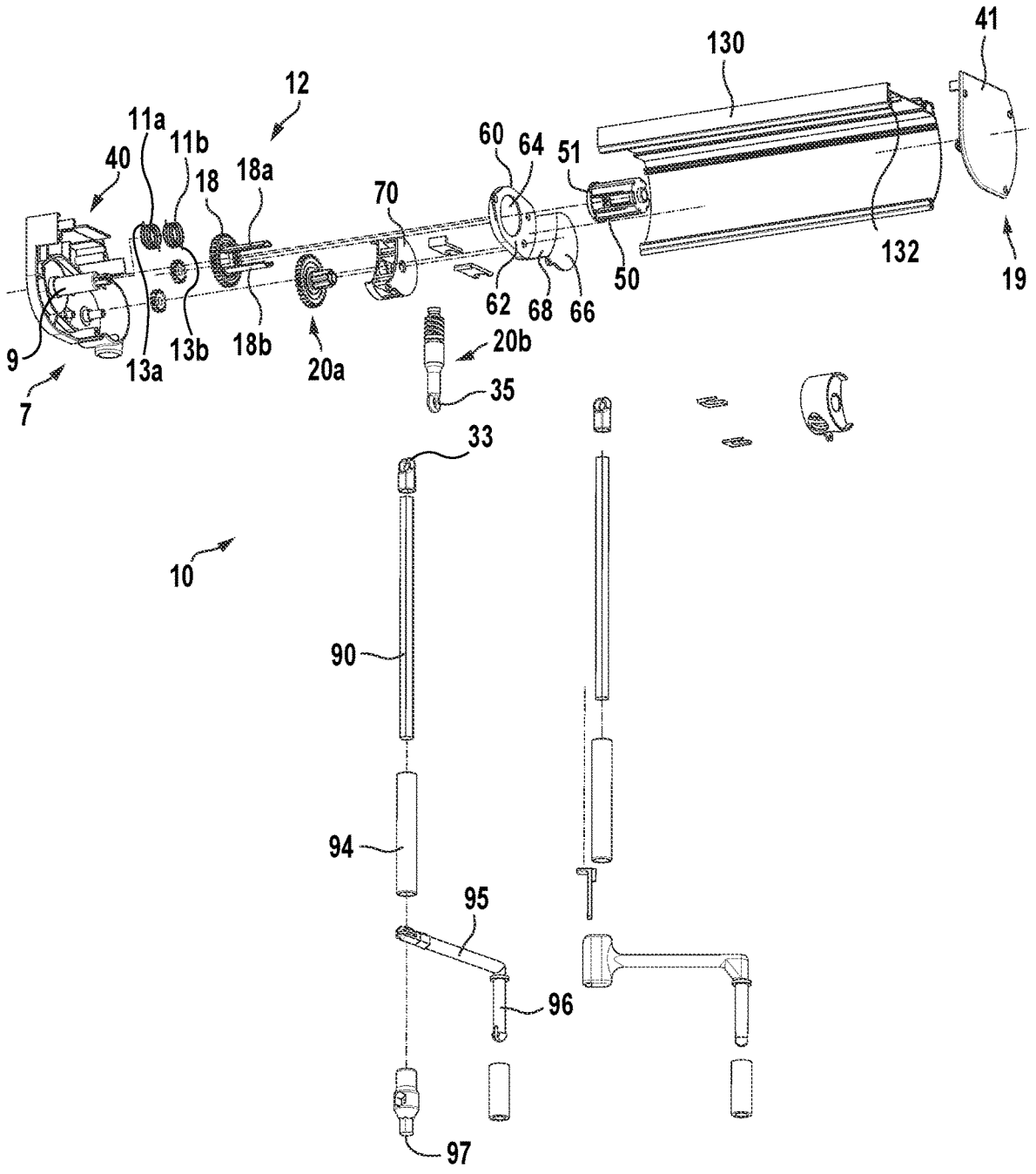
FIG. 1 is an exploded view of the narrow profile control module for a window shade.
Figure 3:
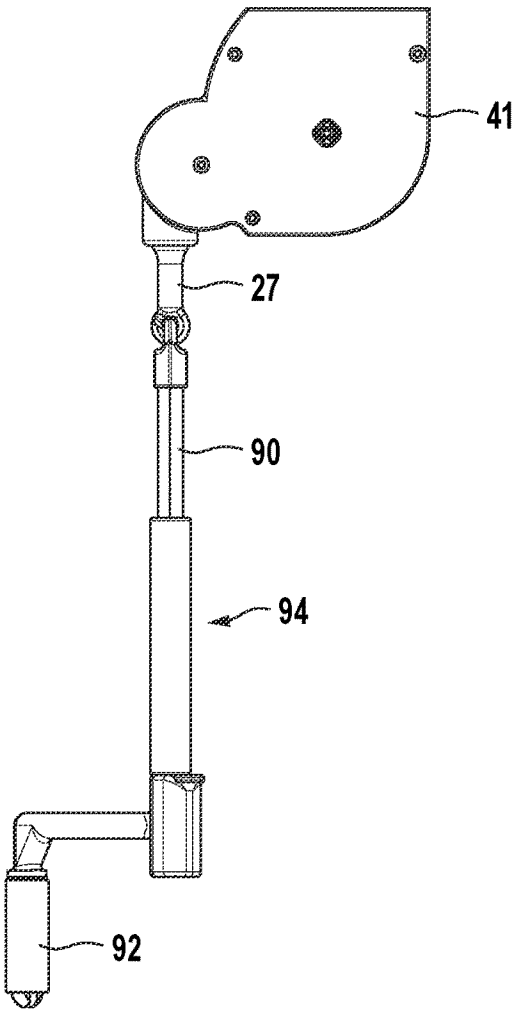
FIG. 3 is a side elevation view of the narrow profile control module for a window shade.

FIG. 1 generally illustrates a blind control 10 for a window covering having a narrow profile. In particular the blind control 10 relates to a control module 12 for a window shade 11 adapted to fit within an opening 14. The opening 14 can be an opening for a window that is comprised of drywall that has an inside edge 17 defining the opening; or in another embodiment the opening may be defined by a window frame comprised of wood or the like adjacent the window opening 14 where the window frame has an inside edge 17.

The control module 12 includes a driven gear 18 disposed between the window shade 11 (FIG. 11C) and inside edge 17 of opening 14 or window frame 16 so as to define a gap 15 between the window shade 11 and edge 17; drive gears 20*a* and 20*b* located outside the gap 15 and engageable with said window shade roll 13 for rotatably driving the driven gear 18 so as to raise and lower said window shade 11; and a rod 90 for driving said drive gears 20*a* and 20*b*.

Figure 11B:
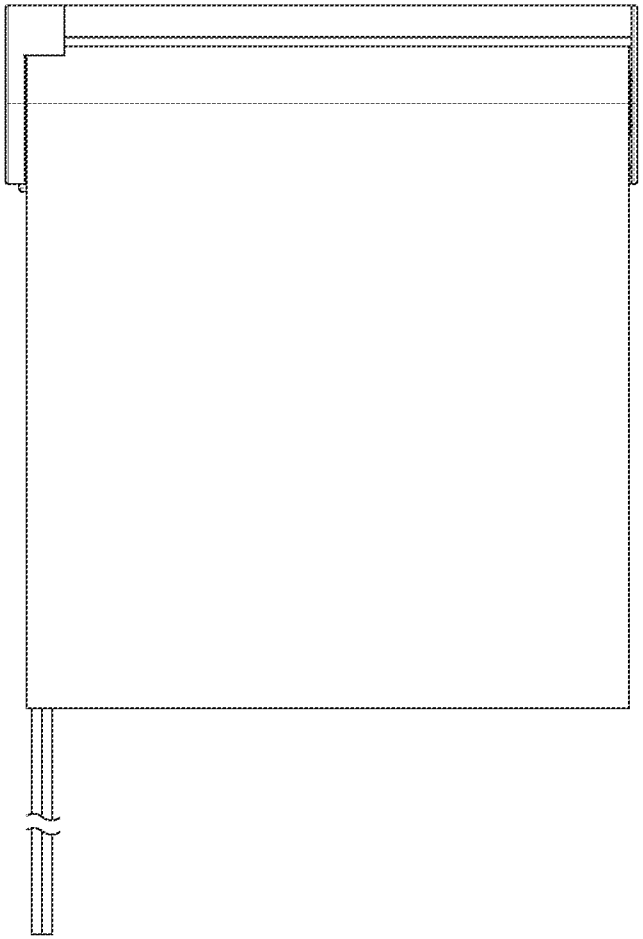
Figure 11A:
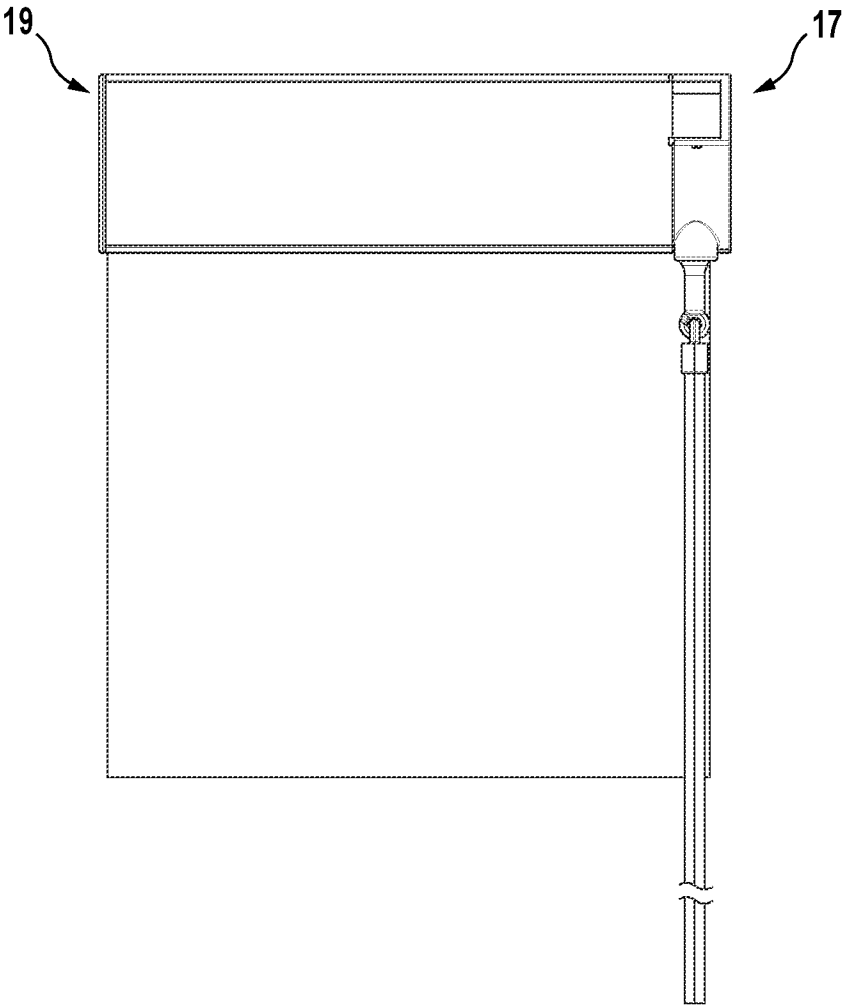
Figure 11E:
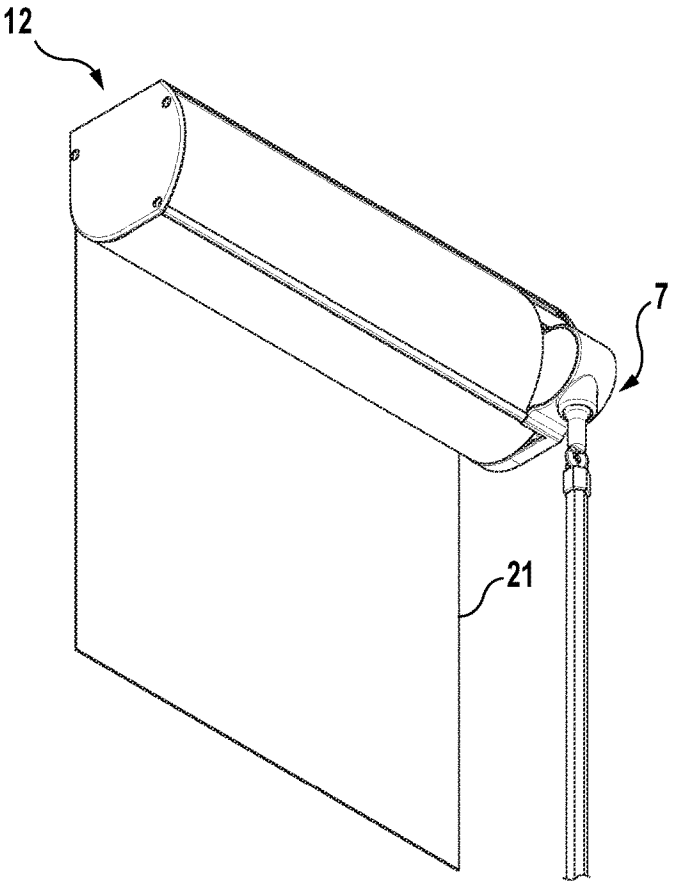
Figure 11C:
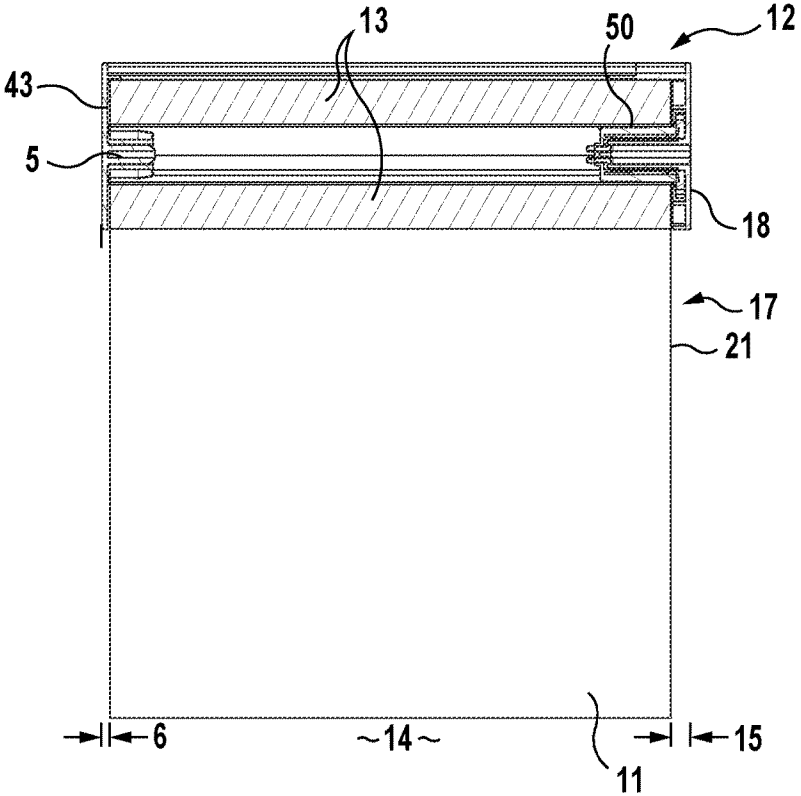
Figure 11D:
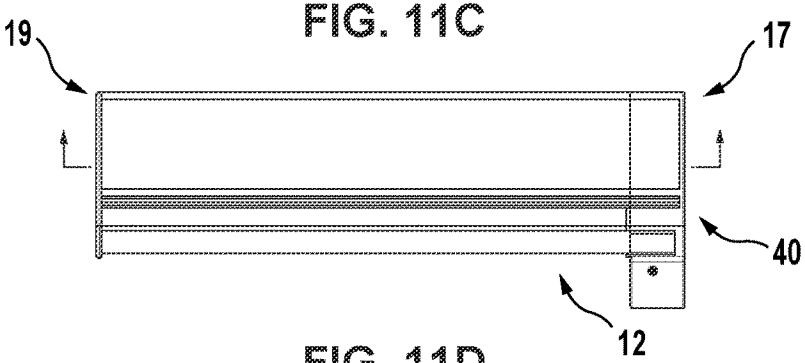

The control module 12 includes a housing 40 having a control end 17 (FIG. 11D) and opposite pin end 19 (FIG. 11D). The control end 17 has the control elements and includes an end wall 41 (FIG. 1) adapted to be disposed adjacent said edge 17 of the window opening 14 as seen in FIGS. 4, 11A, 11B, 11C and 11D. In particular the end of the shade 11, namely one end 21 of the shade roll 13 is preferably as close to the inside edge 17 of the window opening 14 to minimize the gap 15 and block out as much of the light from the outside as possible. A clutch 50 is disposed within the housing 40 and is engageable with the shade roll 13 of window shade 11 in a manner well known to those persons skilled in the art. In particular the clutch 50 is axially rotatable about shaft 9. Two springs 11*a* and 11*b* are coaxially aligned with shaft 90. The shaft 90 and springs 11*a* and 11*b* are received within the clutch 50. The ends 13*a* and 13*b* of the springs 11*a* and 11*b* have projections that engage the openings 50*a* and 50*b* of the clutch 50 so as to prevent the clutch from unravelling in a manner well known to persons skilled in the art.

FIG. 11C shows there is another space 6 between another end of the roll 13 and an opposite edge of window opening 14 which approximately comprises the thickness of the end wall 43 of the pin end 19, since the other end of the shade roll contacts or is very close to the end wall 43. The space 6 is generally smaller than the gap 15, and the invention herein relates to the gap 15 at the control module end 7 of control module 12.

The driven gear 18 is engageable with the clutch 50. In particular the driven gear 18 includes projections 18*a* and 18*b* that are received through the hole 64 into the clutch 50. The clutch 50 is axially disposed between the window shade 11 and said end wall 41. The driven gear 18 rotatably drives said clutch 50 and shade 11 about a clutch axis for raising and lowering said shade 11 relative said window opening 14.

The drive means or gears 20*a* and 20*b* are located in a region away from the gap 15 so as to minimize the gap 15 or distance between one end 21 the shade 11 and edge 17 of window opening 14, or in particular the drive gears 20*a* and 20*b* are located away from the axis of clutch rotation so as not to interfere with the rotating clutch 50 or shade roll 13. In one embodiment the drive gears 20*a*, and 20*b* are radially spaced away from the clutch axis of rotation. In other words the drive gears 20*a* and 20*b* overlie the clutch 50 and shade roll 13 so as not to add any measurement to the gap 15.

The housing 40 includes a first housing portion 42 for receiving said driven gear 18 and a second housing portion 44 communicating with said first housing portion 42, the second housing portion 44 for receiving said drive gear means 20*a* and 20*b*.

In one embodiment the thickness of the driven gear 18 is between 5 to 8 millimeters thick. However this is given by way of example and other thicknesses can be used within the scope of this invention.

In order to constrain the relatively thin thickness of the drive gear 18 a shell plate 60 is used to cover the driven gear 18 in the first chamber 42 and for covering the drive gear 20*a* and 20*b* in the second chamber 44 and constrain said driven gear means 18 and drive gear means 20*a* and 20*b* against flexing and binding.

The first and second chambers 42 and 44 define a chamber, where the first chamber 42 includes a first chamber wall 47 and the second chamber 44 includes a second chamber wall 49, again in order to constrain the drive gear 18 and driven gears 20*a* and 20*b* against flexing and binding, in addition to the shell plate 60.

The shell plate 60 is seen in FIG. 1 and comprises a first shell plate portion 62 having a hole 64 to receive the clutch 50 there through and a second shell plate portion 66. The shell plate 60 has an offset connecting surface 68 connecting the first shell cover portion 62 and the second shell cover portion 66. The offset connecting surface 68 or offset or distance between the first shell plate portion 62 and second shell plate portion 66 provides a means of locating the drive gears 20*a* and 20*b* away from the gap 15 to minimize the gap 15.

More particularly the drive gear 20 comprises a gear 21 connected to pinion gear 23 as best seen in FIG. 5C. The drive gear 20 also includes a worm wheel 25 coaxially connected to drive shaft 27. The gear 21 rotationally drives intermediate gears 29*a* and 29*b* which in turn rotationally drive the drive wheel 18.

A drive gear cage 70 is disposed in the second chamber 44. The cage or shell 70 lies flat against the gear 21 as shown in FIG. 5B. The cage 70 includes a hole 72 for receiving spur gear 23 for rotation therein. The shaft 27 of the spur gear 25 includes two spaced annual recesses 25*a* and 25*b* which are adapted to receive retaining clips 31*a* and 31*b* (FIG. 6A) respectively. The drive gear cage or shell 70 has openings 73*a* and 73*b* (FIGS. 5C, 6A) which are adapted to receive retaining clips 31*a* and 31*b* respectively that engage with annual recesses 25*a* and 25*b* as discussed so as to contain, constrain and retain the drive gear means 20 in a small compartment to rigidify a reduced thickness of the drive so as to minimize the gap 15.

The shell cover 60 includes fastening holes 61*a*, 61*b*, and 61*c* adapted to receive fastens such as screws to tighten the shell or cage cover 60 to the housing 40 and further rigidify the control module 12 against binding.

The drive gear cage 70 is offset away from the plane of the driven gear 18 and gear 21 in a direction away from the end wall 42 and thus away from the gap 15. In other words the spur gear 23 and worm wheel 25 do not contribute to gap dimension thus providing a narrow profile control module as described.

In one embodiment the driven gear 18 comprises a spur gear 18 disposed at said one end 51 of said clutch 50 between said end wall 41 and said one end of said shade so as to define a narrow gap 15 between said one end of said shade and said frame 16 of said window.

In another embodiment the control module 12 comprises at least one intermediate gear 29*a* or 29*b* between said spur gear 18 and said drive gear means 20. The drive gear means 20 in one example is a worm wheel.

The clutch 50 includes selectively engageable braking means for preventing said shade from unrolling when said driven gear or spur gear 18 is idle and includes springs 11*a* and 11*b*. The clutch braking means is well known to those persons skilled in the art and will not be described herein.

The invention described herein relates to a narrow profile control module 12 for a window shade roll 13 comprising; a housing 40 disposed at one end of said window shade roll 13, said housing 40 having a control end wall 41 and first cavity 42 and a second cavity 44, the first cavity 42 communicating with said second cavity 44; a spur gear 18 disposed in said first cavity 42 between said end wall 41 and one end of said window shade roll 13, and defining a gap 15 between one end of said window shade 13 and said edge 17 of the opening 14; a clutch 50 projecting from said spur gear 18 into said window shade roll 13, said spur gear 18 rotatably engageable with said clutch 50 about a clutch axis for raising and lowering said window shade 11; a drive gear means 20 disposed in said second cavity 44 away clutch axis so as to not interfere with said gap 15 adjacent said end wall 41 said drive gear means 20 engageable with said spur gear 18 for rotatably driving said clutch 50 about said clutch axis for rotatably driving the clutch about the clutch axis for raising and lowering the window shade 11; a rod 90 connected to the drive, gear for rotatably driving the spur gear.

In one embodiment the gap is defined as the space between the inside edge 17 of the window opening 14 or frame 16 and one end 21 of the window shade 11 or roll 13.

FIGS. 8A, 8B, 8C, 8D, 8E, 8F, 8G, and 8H are various views of another embodiment of the invention where the drive means 20*a* and 20*b* is a bevel gear 80*a* and 80*b*. The end of the rod 90 also has a bevel gear 80*b*.

FIGS. 2, 3, 6A and 6B show that the rod 90 has a handle 92 that can be used to manually rotate the drive shaft 27 to rotate the drive means 20. The rod or wand 90 also includes a hollow sleeve 94 that can be grasped in one hand while the other hand manually rotates the rod 90 by handle 92.

Alternatively FIGS. 9A, 9B, 9C and 9D are side views of another embodiment of the rod or wand 90. In this case the sleeve 94 is longer than in FIG. 1 and can be moved axially upward or downward so that intermediate horizontal piece 95 and vertical piece 96 are exposed and articulated 90 degrees relative to one another. The drive means 20 can be manually driven in this fashion. Alternatively the sleeve 94 is moved downwardly to cover articulated joints 98 and 99. Once the articulated joints 98 and 99 are covered by sleeve 94 a motor drive (not shown) can engage a socket adapter 97 and rotatably drive the rod 90. The sleeve 94 is long enough to cover the articulated joints 98 and 99 so that the rod does not become twisted when rotated by the motor drive.

Figure 9A:
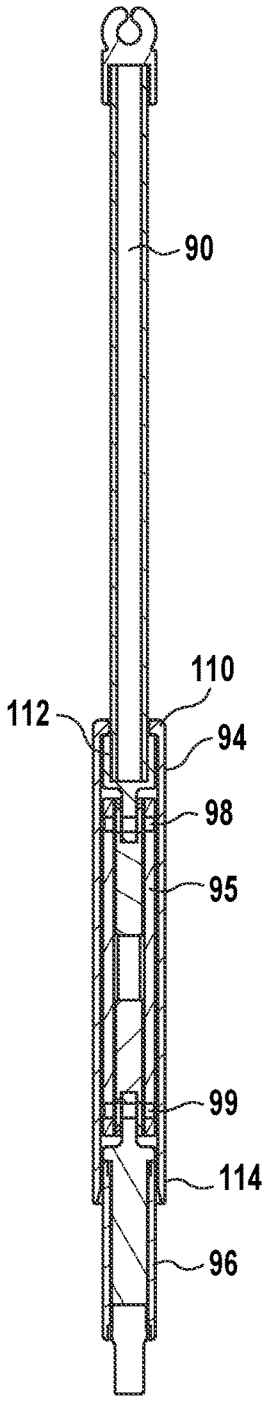
Figure 9B:
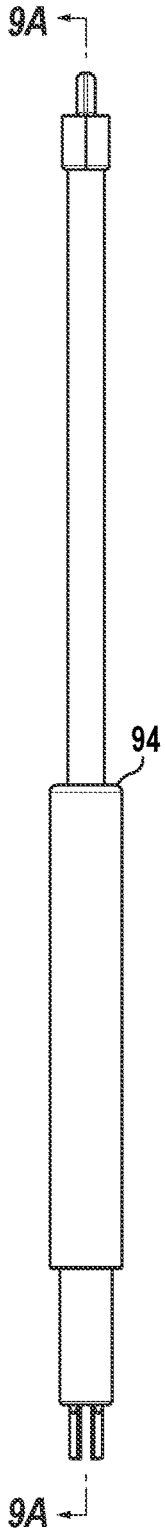
Figure 9C:
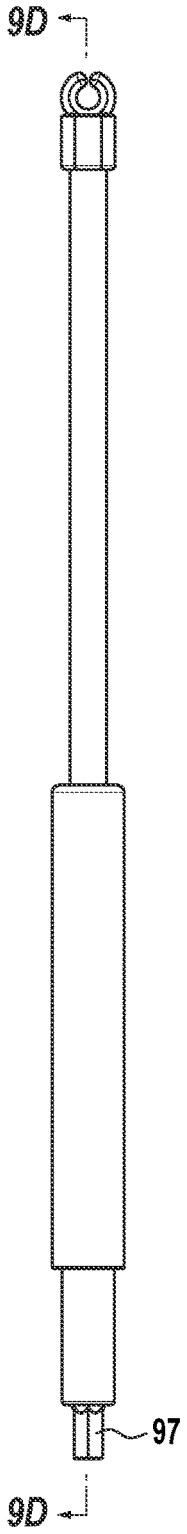
Figure 9D:
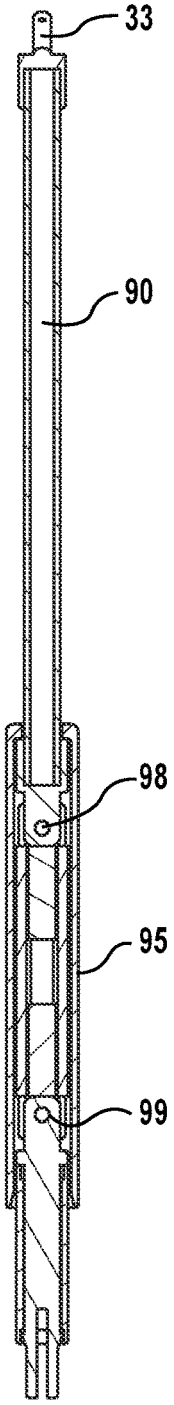
Figure 9E:
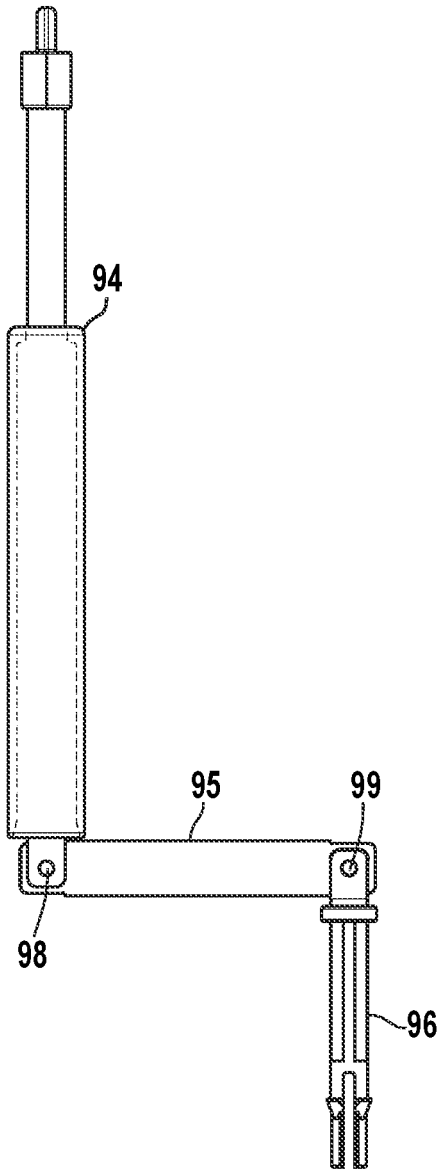

The sleeve 94 has an upper end that has a shoulder 110 which engages a connecting piece 112 when in the lower position as shown in FIG. 9A. The bottom end 114 is tapered so as to self-align as the sleeve 94 moves from the upper position shown in FIG. 9E to the lower position shown in FIG. 9A.

FIGS. 10A, 10B and 10C illustrate a rod or wand 90 which includes a first shaft 99 defining spiral grooves 100*a* and 100*b* and hand pumping portion 102 coaxially receiving said first shaft 99 for reciprocal movement of said hand portion 102 relative said first shaft 99 to rotate said shaft 99 and wand in a selected first or clockwise rotation or second or counter clockwise direction. The hand portion includes a slideable selector 104 for selecting the direction of rotation of said drive gear means 20.

FIGS. 10A, 10B and 10C also illustrate a hand grasping portion 120 which can be grasped by an individual grasping the hand pumping portion 102 by another hand and reciprocately pumps the hand pumping portion 102 up and down in a reciprocating fashion between a first reciprocating position and a second reciprocating position so as to rotate the first shaft 99.

The hand grasping portion 120 is hollow and includes two projections 122 which engage an annular groove 124 as shown; so as to permit rotation of the first shaft 99 relative the hand grasping portion 120.

Furthermore, FIG. 1 illustrates that the controls (driven and driver gears) are housed in the housing 40 while the other opposite end includes a pin end 19. The interior surface of the pin end 19 includes a post which receives a revolving pin 5 as best seen in FIG. 11C which coaxially receives the other end 43 of the shade roll 13 for rotation of a clutch axis and shade roll axis.

FIG. 1 also shows an exploded view of a cassette 130 which can be comprised of aluminum or plastic or the like and includes a plurality of extensions or rails that are adapted to engage (not shown) for attachment adjacent a window opening 14. The brackets 132 allow a user to fasten the bracket (not shown) to adjacent the window opening 14 first and thereafter snap the cassette 130 in place for easy installation.

The arrangements shown in FIG. 1 can be reversed so that the control end 7 is located on the opposite end depending on which side of the window cassette the user desires to place the wand 90. The control end 7 shown in FIG. 1 consists of a right control cap while the opposite pin end 19 comprises a left end cap. However these can be reversed.

Figure 2:
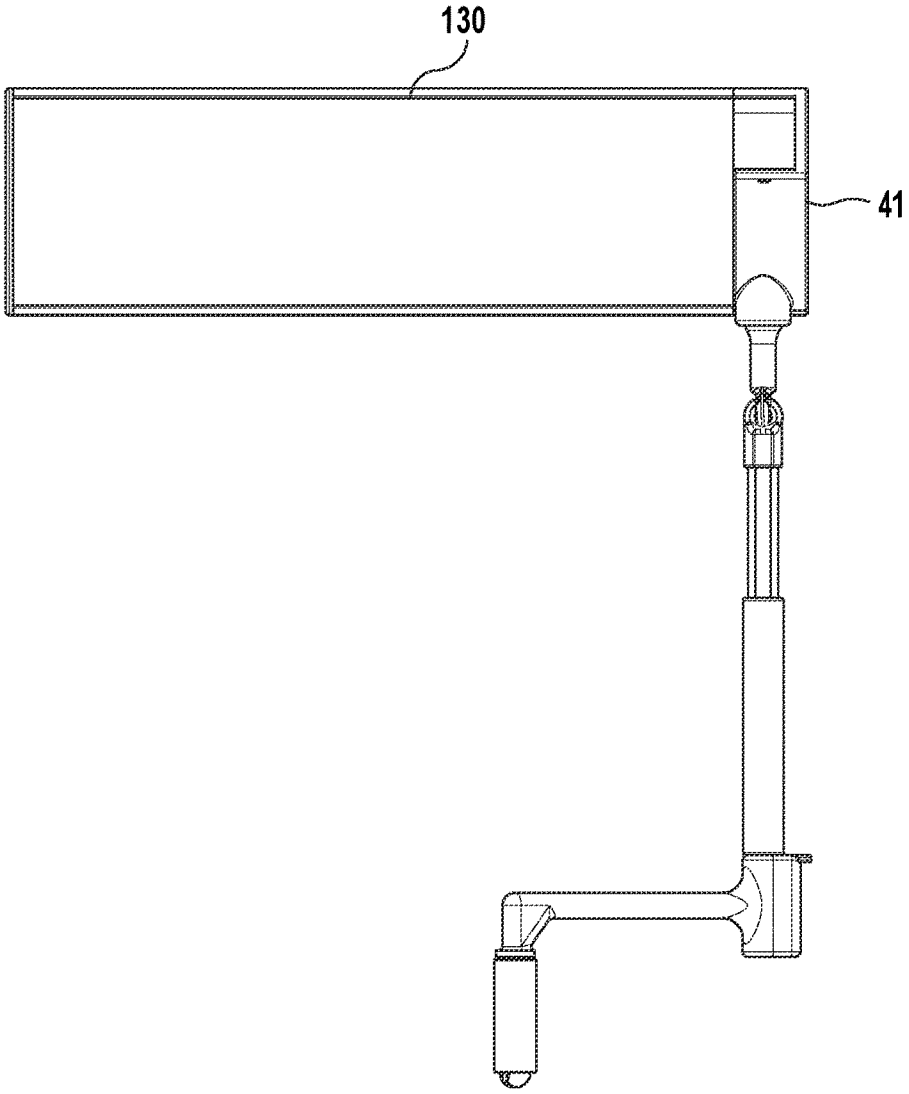
FIG. 2 is a front elevation view of the narrow profile control module for a window shade.
Figure 4:
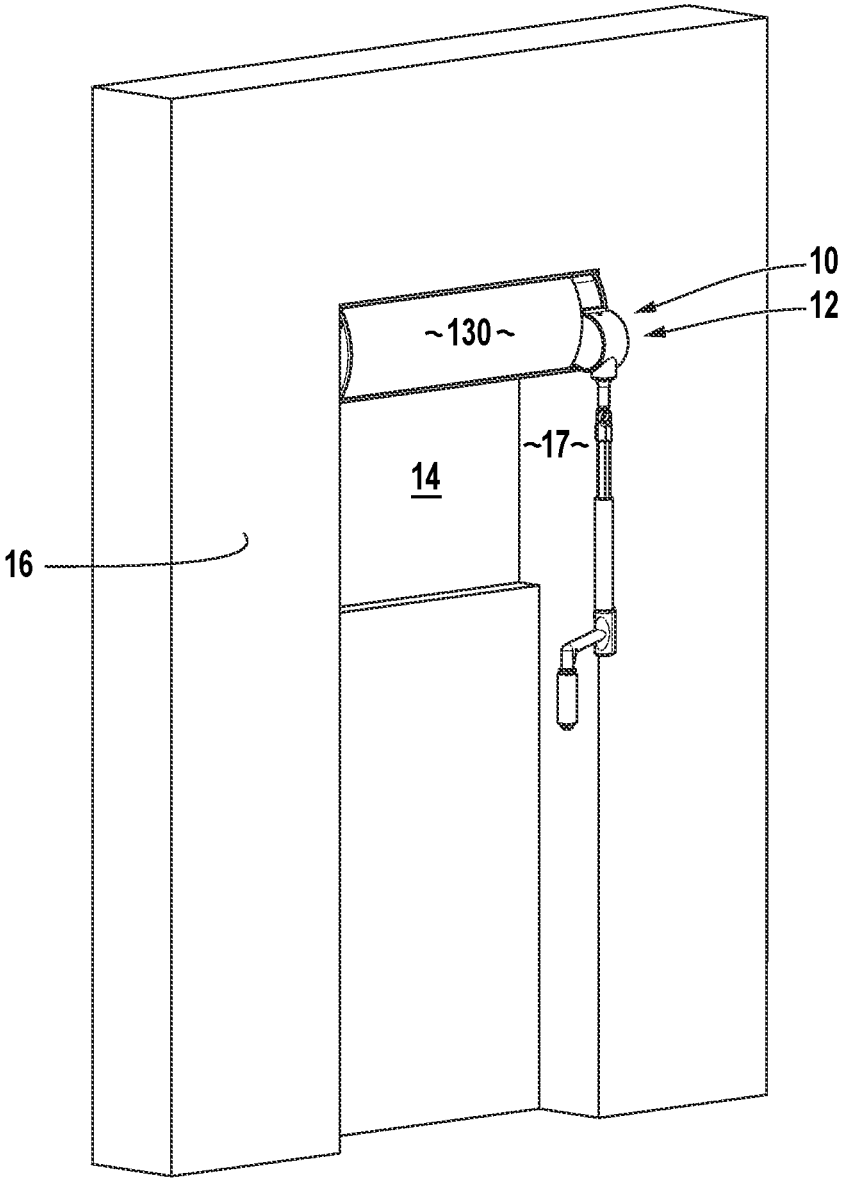
FIG. 4 is a perspective view of the control module.

The left side of the cassette 130 of FIG. 2 presents the pin end cap while the right side of FIG. 2 presents the right control cap.

The cassette 130 covers the internal mechanism of the control elements.

Figure 12A:
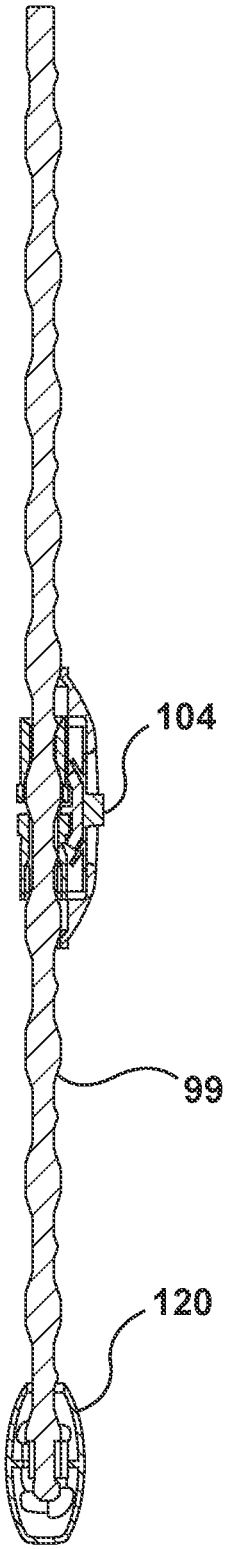
Figure 12B:
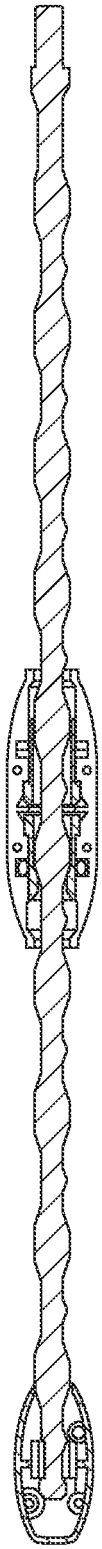
Figure 12C:
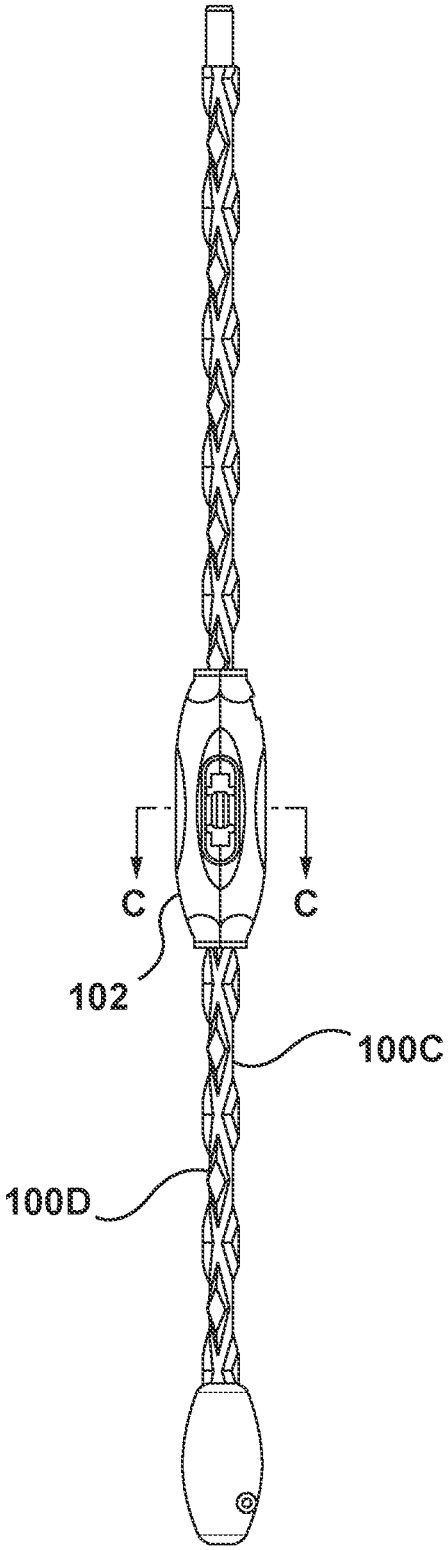
Figure 12D:
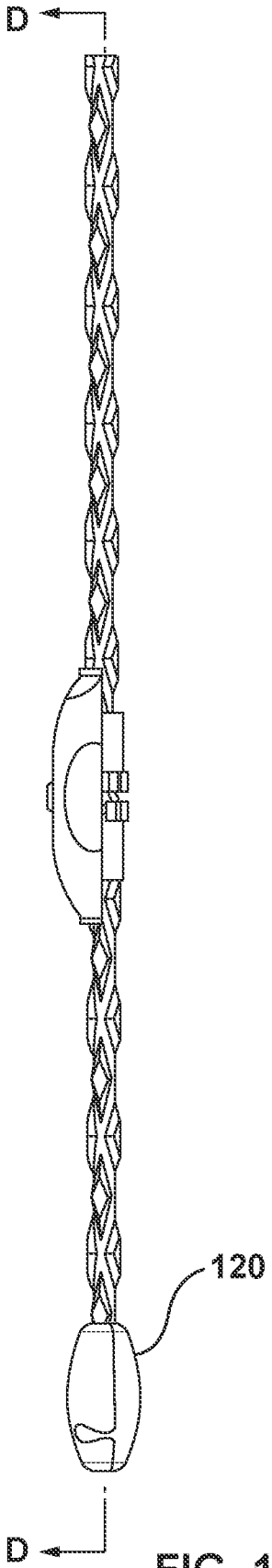
Figure 12E:
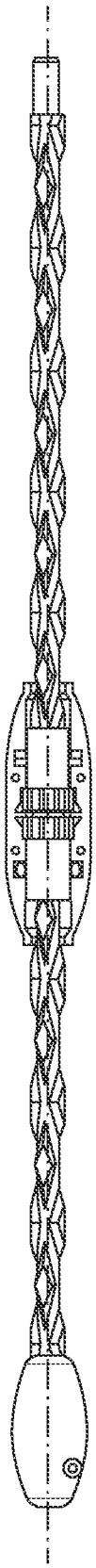
Figure 12F:
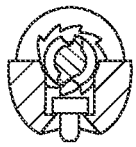

FIGS. 12A, 12B, 12C, 12D, 12E and 12F are another embodiment of the wand, similar to FIGS. 10A-10C except the helical grooves have been replaced with protrusions, 100C 100D; but otherwise operate in a similar manner to that as shown in FIGS. 10A-10C. Furthermore FIG. 12F is cross sectional view of FIG. 12C along the lines C-C.

Another embodiment of the invention is shown in FIGS. 13,14, 15, 16, 17 and 18 whereby the drive shaft 27 is disposed by an angle as best seen FIG. 15. Such embodiment maybe useful when in use with wide slats such as wooden slats in the window coverings, which slats may protrude beyond on the housing 40.

In such arrangement the wand as (for example as shown in FIGS. 10A-10C FIGS. 12A-12F) would hang vertically downwardly from the connecting loop 35 of the drive shaft 27 in a first position. However, in order to raise or lower the shade the wand shaft 99 or 90 as previously described would be moved by the user so that the axis of the shaft 99 would be in line with or coaxial with the axis of the shaft 27 in a second operable position thereby permitting rotation as previously described in order to raise or lower the shade material.

Furthermore, FIG. 16 illustrates that a bevel gear 80*b* in another embodiment located at the end of the shaft 27 (rather than the worm gear as shown in FIG. 1) so as the engage a clutch 50 having a spur gear 18 at the end thereof.

What is claimed is:

1. A control module to control a window shade comprising;

a housing having an end wall, a shell plate, a first cavity and a second cavity;

a driven gear means housed in said first cavity between said shell plate and said end wall, said driven gear means adjacent one end of said window shade;

drive means housed in said second cavity to rotatably drive the driven gear means and rotatably drive said window shade about an axis so as to raise and lower said window shade relative an opening;

wherein said drive means housed in said second cavity is positioned axially inward from said one end of said window shade such that the shell plate and drive means overlap a face of the window shade and the drive means housed in said second cavity is axially spaced inward from the first cavity.

2. The control module as claimed in claim 1 wherein said control module includes a clutch disposed within said housing and engageable with said window shade, said driven gear means engageable with said clutch.

3. The control module as claimed in claim 2 wherein the drive means comprises a drive gear means between said shell plate and said end wall and engageable with said driven gear means to rotationally drive said clutch and said window shade about said axis for raising and lowering said window shade.

4. The control module as claimed in claim 3 wherein said second housing portion is radially spaced from said axis.

5. The control module as claimed in claim 3 wherein said shell plate covers said driven gear means in said first cavity and covers said drive gear means in said second cavity and constrains said drive gear means and driven gear means against binding.

6. The control module as claimed in claim 5 wherein said driven gear means comprises a spur gear disposed at one end of said clutch between said end wall and said shell plate so as to define a gap distance between said one end of said shade and said end wall.

7. The control module as claimed in claim 6 wherein the gap distance between said one end of said shade and said end wall is between 5 to 8 millimeters.

8. The control module as claimed in claim 7 wherein the drive gear means is either a worm wheel or bevel gear.

9. The control module as claimed in claim 6 further including at least one intermediate gear between said spur gear and said drive gear means.

10. The control module as claimed in claim 9 wherein said clutch includes selectively engageable braking means for preventing said shade from unrolling when said driven gear means is idle.

11. A control module to control a window shade roll comprising;

a housing disposed at one end of said window shade roll, said housing having a control end wall, a shell plate and a first cavity and a second cavity, said first cavity communicating with said second cavity;

a spur gear disposed in said first cavity between said control end wall and shell plate, to define a gap distance between said shell plate and said control end wall, said spur gear adjacent said one end of said window shade roll;

a clutch projecting from said spur gear into said window shade roll, said spur gear rotatable with said clutch about a clutch axis for raising and lowering a window shade from said window shade roll;

drive gear means disposed in said second cavity and engageable with said spur gear for rotatably driving said clutch about said clutch axis for raising and lowering said window shade;

wherein said wherein said drive gear means in said second cavity is positioned axially inward from said one end of said window shade such that the shell plate and drive means overlap a face of the window shade and the drive means housed in said second cavity is axially spaced inward from the first cavity;

a rod connected to said drive gear means to rotatably drive said spur gear.

12. The control module as claimed in claim 11 wherein said gap distance is between 5 and 8 millimeters.

13. The control module as claimed in claim 11 wherein said drive gear means includes a worm gear engageable with said spur gear.

14. The control module as claimed in claim 11 including at least one intermediate gear between said spur gear and said drive gear means.

15. The control module as claimed in claim 11 wherein the drive gear means is either a worm wheel or bevel gear.

16. A control module to control a window shade comprising;

a housing having an end wall and a shell plate;

a driven gear means disposed within said housing between said shell plate and said end wall, said driven gear means adjacent one end of said window shade;

drive means disposed within said housing and engageable with said window shade for rotatably driving the driven gear means so as to raise and lower said window shade relative the opening;

wherein said drive means is positioned inward from said end wall and overlaps said one end of said window shade;

and a wand for driving said drive means;

said wand including a shaft defining two intersecting spiral grooves and a hand portion coaxially receiving said shaft for reciprocal movement of said hand portion relative said shaft to rotate said wand, and a selector carried on said hand portion to selectively switch the rotation of said shaft in a selected first or second direction; wherein said selector allows engagement into a specific spiral groove of the two intersecting spiral grooves in order to select the specific direction of the rotation of the wand.

17. A control module to control a window shade comprising;

a housing having an end wall and a shell plate;

a driven gear means disposed within said housing between said shell plate and said end wall, said driven gear means adjacent one end of said window shade;

drive means disposed within said housing and engageable with said window shade for rotatably driving the driven gear means so as to raise and lower said window shade relative the opening;

wherein said drive means is positioned inward from said end wall and overlaps said one end of said window shade;

and a rod for driving said drive means;

wherein said rod comprises a shaft defining two spiral intersecting grooves or two spiral intersecting protrusions and a hand portion coaxially receiving said two intersecting spiral grooves or two intersecting spiral protrusions for reciprocal movement of said hand portion relative said two intersecting spiral grooves or two intersecting spiral protrusions to rotate said shaft in a selected first or second direction to lower or raise said window shade and a selector on said hand portion to selectively switch the rotation of said shaft; wherein said selector allows engagement with a specific spiral groove or specific spiral protrusions of the two intersecting spiral grooves or two spiral intersecting protrusions in order to select the specific direction of the rotation of the wand.

18. The control module as claimed in claim 17 wherein each of said two intersecting spiral protrusions are defined by two spaced opposite side walls extending radially outwardly from said shaft, each said spaced opposite side walls having a bottom edge and top edge and the space between the top edge of each said spaced opposite side walls being less than the space between the bottom of each said spaced opposite side walls.

19. The control module as claimed in claim 18 wherein said drive means includes a drive shaft disposed at an angle relative the housing and said rod hangs vertically downwardly from said drive shaft in a first position and is moveable to a second operable position to drive said drive shaft.

20. A control module to control opening and closing a widow shade comprising:

a shaft defining two spiral intersecting grooves or two spiral intersecting protrusions and a hand pumping portion coaxially receiving said two intersecting spiral grooves or two intersecting spiral protrusions for reciprocal movement of said hand pumping portion relative said two intersecting spiral grooves or two intersecting spiral protrusions to rotate said shaft in a selected first or second direction to lower or raise said window shade, and a switch carried on said hand pumping portion to selectively switch the rotation of said shaft; wherein said switch allows engagement with a specific spiral groove or specific spiral protrusion of the two intersecting spiral grooves or two spiral intersecting protrusions in order to select the specific direction of the rotation of the wand.

21. A control module as claimed in claim 20 wherein a first end of said shaft includes an attachment to suspend said shaft from said window shade and a second end of said shaft includes a hand grasping portion with said hand pumping portion disposed coaxially on the shaft for reciprocal movement of said hand pumping portion between said first and second end.

22. A wand for attachment to a window shade assembly comprising;

a) a shaft defining two spiral intersecting grooves or two spiral intersecting protrusions and a hand pumping portion coaxially receiving said two intersecting spiral grooves or two intersecting spiral protrusions for reciprocal movement of said hand pumping portion relative said two intersecting spiral grooves or two intersecting spiral protrusions to rotate said shaft in a selected first or second direction to lower or raise said window shade;

b) wherein a first end of said shaft includes an attachment to attach said shaft to a control module and a second end of said shaft includes a hand grasping portion with said hand pumping portion disposed coaxially on the shaft for reciprocal movement between said first and second end; and c) wherein each:

i) said groove is defined by two spaced groove side walls extending radially outwardly from said shaft, each said spaced groove side walls having a bottom edge and top edge and the space between the top edge of each said spaced groove side walls is greater than the space between the bottom edge of each said spaced groove side walls; or ii) said protrusions is defined by two spaced opposite protrusion side walls extending radially outwardly from said shaft, each said spaced opposite protrusion side walls having a bottom edge and top edge and the space between the top edge of each said spaced opposite protrusion side walls being less than the space between the bottom edge of each said spaced opposite protrusion side walls.

23. The wand as claimed in claim 22 further including a switch disposed on an exterior surface of said hand pumping portion to selectively switch the rotation of said shaft; wherein said switch allows engagement with a specific spiral groove or specific spiral protrusion of the two intersecting spiral grooves or two spiral intersecting protrusions in order to select the specific direction of the rotation of the wand.

* * * * *